United States Patent [19]

Durkee, Jr. et al.

[11] Patent Number: 4,977,935

[45] Date of Patent: Dec. 18, 1990

[54] INTERLOCK SYSTEM

[75] Inventors: William D. Durkee, Jr., Selkirk; Philip J. Muller, Ravena, both of N.Y.

[73] Assignee: General Electric Company, Selkirk, N.Y.

[21] Appl. No.: 424,488

[22] Filed: Oct. 20, 1989

[51] Int. Cl.[5] ..... B65B 1/04; B67C 3/00

[52] U.S. Cl. ..... 141/99; 141/311 R; 141/94; 141/383; 285/18; 285/93; 137/597

[58] Field of Search ..... 141/94, 31 R, 383, 382, 141/98, 99; 285/18 X, 93 X, 920; 137/552, 551, 602, 624.18, 625.18, 625.42, 637.1, 597 X

[56] References Cited

U.S. PATENT DOCUMENTS

| | | | |
|---|---|---|---|
| 3,076,473 | 2/1963 | Wadey | 137/597 |
| 3,796,239 | 3/1974 | Zindler et al. | 141/94 |
| 3,822,729 | 7/1974 | Rochette | 141/98 |
| 4,000,976 | 1/1977 | Kramer et al. | 141/98 |
| 4,263,945 | 4/1981 | Van Ness | 141/98 |
| 4,469,149 | 9/1984 | Walkey | 141/98 |
| 4,744,385 | 5/1988 | Houghton | 137/637.1 |
| 4,846,233 | 7/1989 | Fockens | 141/94 |

FOREIGN PATENT DOCUMENTS

| | | | |
|---|---|---|---|
| 2502134 | 9/1982 | France | 141/94 |

*Primary Examiner*—Henry J. Recla
*Assistant Examiner*—Keith K. Kupferschmid
*Attorney, Agent, or Firm*—Francis T. Coppa; Fred Jacob

[57] ABSTRACT

An interlock system acts in conjunction with an arrangement in which selected ones of first and second pluralities of equipment for conveying chemicals are interconnected in accordance with a chosen operation of a process or apparatus. A separate information carrier corresponds to each piece of equipment of the first plurality and a control unit corresponds to each piece of the second plurality. The interlock system establishes an appropriate set of operating parameters for the chosen operation when the information carrier which corresponds to the interconnected first piece of equipment engages the control unit corresponding to the interconnected second piece of equipment.

16 Claims, 4 Drawing Sheets

INTERLOCK SYSTEM

The present invention relates in general to new and improved interlock systems and in particular to interlock systems of the type used in a process or apparatus for establishing separate operating parameters for each of a plurality of different operations.

BACKGROUND OF THE INVENTION

Articles formed by extrusion or compression molding, or by a related process or apparatus, are generally made from a composition material. Before fabrication begins, the composition material is prepared from its constituent chemicals which may reside in separate silos or other storage facilities. Each storage facility is permanently connected by means of a pipe or the like to a receiving point of a transfer area where appropriate interconnections are made to transfer each received constituent to a particular delivery point, as determined by the operation which is to be carried out. Each delivery point is permanently connected by a pipe or the like to a location outside the transfer area where further processing or fabricating steps are performed. For example, a delivery point may be coupled to a mixer, a blender, a verification bin, etc., or it may be coupled directly to an extrusion or injection molding device.

The transfer area in existing installations typically consists of an enclosed room having the aforesaid receiving and delivery points permanently embedded in the walls, or in the ceiling and floor of the room. The number of receiving points may be more or fewer than the number of delivery points. Within the transfer area, each receiving point is permanently coupled to a flexible hose, e.g. a metal hose, or to a hose that is rigid in part but which has a flexible end portion. Each delivery point is permanently coupled to a fixed interconnection station within the transfer area. It will be understood that, although the aforesaid coupling connections are designated and intended to be permanent connections, they can be dismantled or shifted if required.

In order to link certain specified receiving points with designated delivery points, as required by a particular operation, the flexible hoses that are permanently coupled to the specified receiving points are selected for connection to selected fixed stations, the latter corresponding to the designated delivery points. The interconnection between the selected hoses and the selected fixed stations is normally made manually in the transfer area.

Each chosen operation requires a specific set of operating parameters which determine such factors as the feed rate of a particular chemical constituent material, the duration of feed, temperature, etc. These operating parameters are established through a manual interlock system in communication with a computer that supervises the overall process to be carried out. In the arrangement described above, the computer sets the appropriate parameters when it is notified of the chosen operation, i.e. when it is informed of the paths established by the connection of the selected flexible hoses to the selected interconnection station. Notification occurs by way of an electrical signal which is transmitted through a communication channel established at the time each interconnection is made.

In a commonly used arrangement, each fixed station has an electrical receptacle associated therewith to which a male connector portion, attached to the flexible metal hose, is connected whenever the flexible hose is to be coupled to the fixed station. In one example, a 2-part connector which is commercially available as a Cannon plug, includes a male connector portion attached to the flexible hose. The connector portion has pins that engage corresponding holes in the electrical receptacle that is positioned on or near the selected fixed station.

A number of problems arise from such an arrangement, all related to the physical environment of the transfer area. The atmosphere of the transfer area, particularly if enclosed, is usually heavy with the chemicals carried by the flexible metal hoses that are manually connected and interconnected within the room. Unless both parts of the electrical connector are shielded when disconnected, the chemical dust can intrude and foul one or more pin connections. Where such is the case, it may result in the transmission of an incorrect signal to the computer, so that a false set of operating parameters is established.

In addition to fouling, the typical electrical connector frequently cannot withstand the rough handling that is common in the environment described. When a pin is bent or breaks, e.g. during the connection or disconnection of the two connector halves, it either prevents an electrical connection from being established, or it can result in the transmission of an incorrect signal to the computer. Such pin damage can also occur when the relatively heavy end of a flexible metal hose is dropped on the electrical connector, a not infrequent occurrence when a hose is disconnected. Finally, the atmosphere in the transfer area may be explosive, depending on the chemicals being mixed. Where that is the case, the interconnection and disconnection, particularly the latter, of the separate connector halves poses a danger due to the possibility of sparking.

OBJECTS OF THE INVENTION

It is a principal object of the present invention to provide a new and improved interlock system which is not subject to the foregoing problems and disadvantages.

It is another object of the present invention to provide a new and improved interlock system which can withstand rough handling in the environment of a transfer station.

It is a further object of the present invention to provide a new and improved interlock system which is relatively immune to the presence of dirt and dust in its immediate environment.

It is an additional object of the present invention to provide a new and improved interlock system which avoids the use of exposed electrical contacts in the atmosphere of the transfer area.

SUMMARY OF THE INVENTION

In accordance with the present invention, an interlock system is provided in which a separate information carrier is assigned to each of a number of flexible metal hoses through which chemicals are received. Each information carrier takes the form of a key which is attached to its corresponding flexible hose. A separate, sealed control box is assigned to each of a number of fixed interconnection stations and is positioned nearby. Each control box includes an externally mounted keyway, as well as internally carried probe means. Each key is capable of engaging the keyway of any selected control box and it bears indicia which are sensed by the probe means when the key is inserted into the keyway.

Full key insertion is detected by a series of proximity switches which constitute part of the probe means and which generate a binary output signal indicative of the code designated by the indicia on the key. This output signal is fed to an external computer which controls the overall process or apparatus within which the chosen operation is to be carried out and which sets the required operating parameters.

These and other objects of the present invention, together with further features and advantages thereof will become apparent from the following detailed specification when read in conjunction with the accompanying drawings.

DETAILED SPECIFICATION

Figure 1:
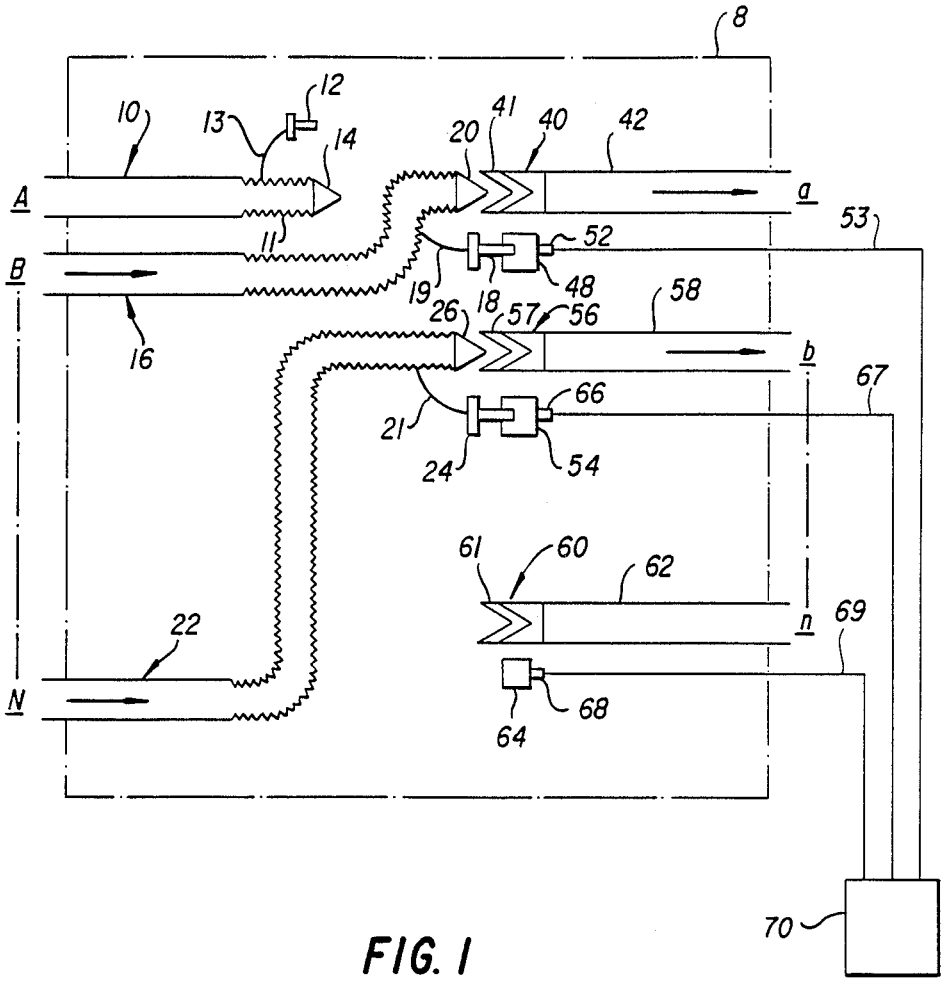
FIG. 1 is a schematic representation of the transfer area in accordance with the present invention.

With reference now to the drawings, FIG. 1 illustrates in schematic form a transfer area 8, which may be a walled-in room having a first number of delivery points a, b, . . . n, and a second number of receiving points A, B . . . N. The delivery and receiving points are points to which external pipes may be attached to communicate with the environment outside the transfer area. These points may be located in the walls of the room, and/or in the ceiling and floor. The number of receiving points will depend on the number of storage areas from which chemicals are received, while the number of delivery points, which may be greater or less than the number of receiving points, will depend on the number of material processing stations, mixers, injections molds and other apparatus that may be required.

As shown in FIG. 1, a metal hose 10 is permanently coupled to receiving point A. Metal hose 10 may be flexible throughout, or it may be rigid in part and include a flexible end portion 11. Hose 10 terminates in a hose coupling 14. A key 12, discussed in greater detail below, is loosely attached to flexible hose 10 by means of a tether 13. Receiving point B is permanently coupled to a metal hose 16 which terminates in a hose coupling 20. As in the case of hose 10, hose 16 may be flexible throughout or in part only. A key 18 is loosely attached to hose 16 by means of a tether 19.

Each receiving point of the transfer area has a flexible metal hose permanently coupled thereto, substantially in the manner described above with respect to points A and B. As shown in FIG. 1, the last receiving point, i.e. point N, has flexible metal hose 22 permanently coupled thereto. Hose 22 terminates in a hose coupling 26. A key 24 is loosely attached to hose 22 by means of a tether 21.

A fixed interconnection station 40 includes a receptacle 41 capable of mating with any of the hose couplings 14, 20 . . . 26 of the flexible metal hoses present in the transfer area. Fixed station 40 connects to one end of a transfer pipe 42, whose other end is permanently coupled to delivery point a. Positioned near fixed, station 40, or attached thereto, is a control box 48 which includes an electrical connector plug 52. An electrical conduit 53 connects plug 52 to an external computer 70.

In similar manner, a fixed station 56 includes a receptacle 57 capable of accepting any of the hose couplings. A transfer pipe 58 connects fixed station 56 to delivery point b. A control box 54, which may be attached to fixed station 56 or positioned proximate thereto, is connected to computer 70 by way of a connector plug 66 and an electrical conduit 67.

The remaining fixed stations in the transfer area are substantially identical in construction. As shown, fixed station 60 includes a hose receptacle 61. A transfer pipe 62 connects fixed station 60 to delivery point n. A control box 64 is positioned proximate fixed station 60, or is attached thereto. It is electrically connected to computer 70 by way of a connector plug 68 and an electrical conduit 69.

Figure 2:
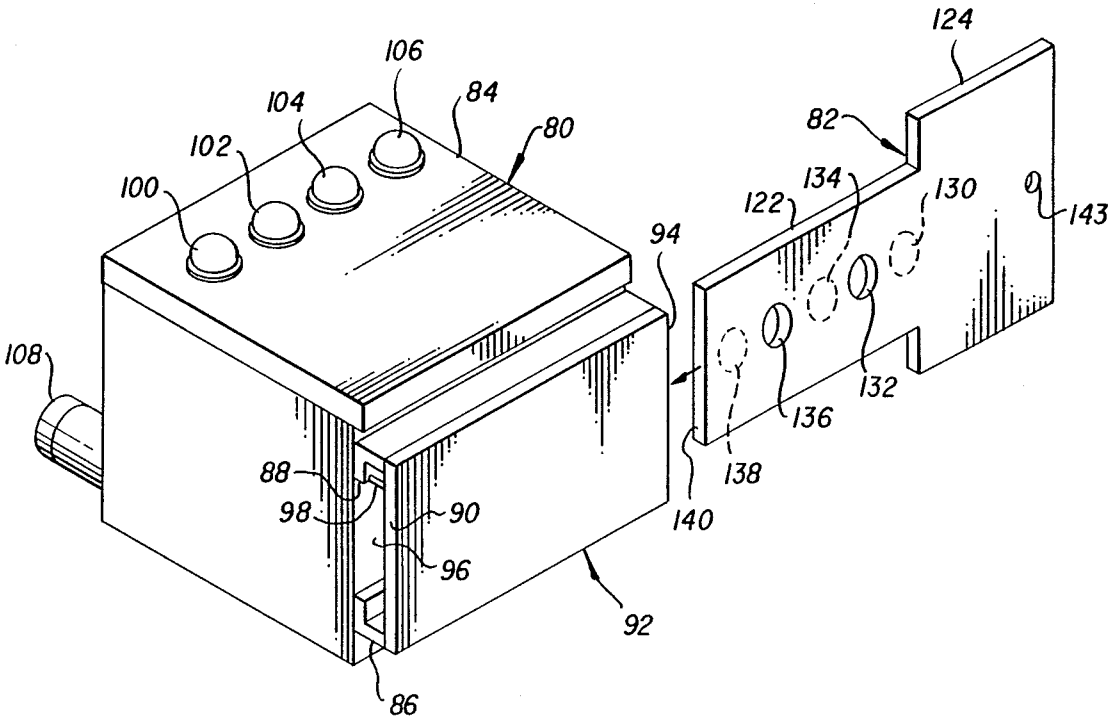
FIG. 2 is an isometric view of a preferred control box and key in accordance with the present invention.
Figure 3:
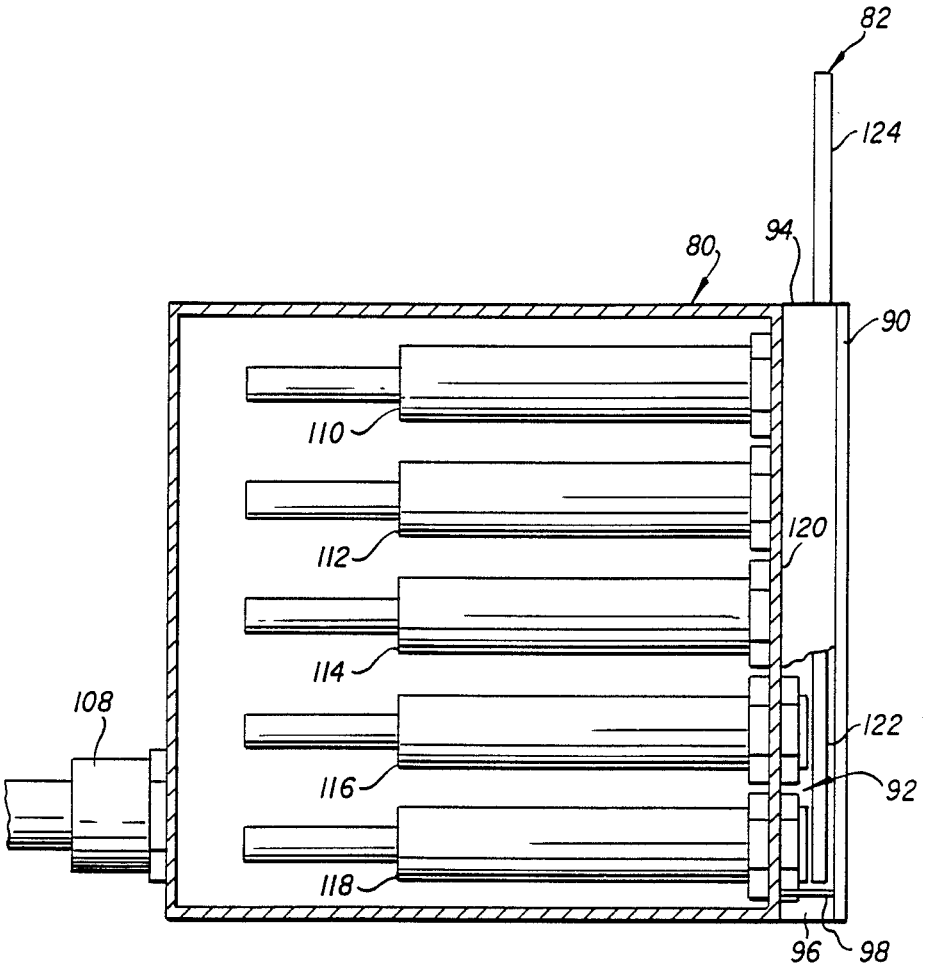
FIG. 3 is a view of the control box with the cover removed and a portion of the keyway exposed.

FIGS. 2 and 3 illustrate an exemplary control box 80 and a key 82, identical to those shown in FIG. 1. Control box 80 includes a cover 84 which, together with the box itself, provides a sealed enclosure to keep out ambient dust and dirt. A pair of keyway guides 86 and 88, together with a plate 90, form a keyway 92 on the outside of box 80. Keyway 92 extends between a path entry 94 and a path termination 96, the latter including a transverse pin 98 to prevent the entry of a key. Cover 84 of control box 80 has a set of signal lights 100, 102, 104 and 106 mounted externally thereon. Control box 80 also carries a connector plug 108 for electrical communication between the interior and the outside of the control box.

As best shown in FIG. 3, the interior of control box 80 contains a set of proximity probes 110, 112, 114 and 116, as well as a proximity check probe 118. The probes may be of the kind that are commercially available as Induction Proximity Probe ATC 8034AL02FL2AAXX and each includes a coil which is part of an oscillator circuit. Each probe further includes a switch for making or breaking the circuit in which the probe is connected. When a current is applied, an RF field is created in the immediate vicinity of the probe. If a metal object is placed into this RF field, enough energy is absorbed from the field to stop the oscillation and thereby cause the switch to close. A circuit that includes the switch can thus be controlled in accordance with metal objects sensed by the probe.

Probes 110–116 are spaced successively along the keyway, check probe 118 being located closest to path termination 96. As best shown in the exposed portion of FIG. 3, each probe extends through wall 120 of the control box into keyway 92 which is externally mounted on wall 120. The probes remain out of contact with key 82, the latter being shown fully inserted into the keyway in FIG. 3.

Key 82 consists of a plate of metal of uniform thickness, preferably stainless steel. As illustrated in FIG. 2, key 82 includes a read portion 122 and a gripping portion 124 as a integral parts of the key. The width of read portion 122 is selected to enable it to enter keyway 92 through path entry 94. The clearance provided between the key and the keyway is relatively small in order to limit the movement of the key to a direction parallel to the long dimension of the keyway. Gripping portion 124 has width greater than that of the keyway, so that the latter can accept only the read portion of the key.

Read portion 122 is shown with indicia located in five discrete areas 130, 132, 134, 136 and 138, which are successively spaced along the long dimension of the read portion. The indicia in areas 130, 132, 134 and 136 represent a 4-digit binary code. Area 138, positioned closest to forward end 140 of the key, contains a check digit. In a preferred embodiment of the invention, the indicia by which the code digits and the check digit are represented consist of holes or the absence of holes, representative of binary ZEROs or ONEs respectively. In FIG. 2 the holes are represented in solid lines, e.g. as shown at 132 and 136. The absence of holes is schematically indicated by means of a circle drawn in broken lines, e.g. as shown at 130, 134 and 138. Thus, the code represented by the four code digits in areas 130–136 is 0101.

The 4-digit code on the read portion of each key designates a set of operating parameters, or perhaps a single parameter of a set, required by a particular operation. The designated operation can be carried out only when the flexible hose to which the key is tethered is selected for interconnection with a particular selected fixed station. Sixteen sets of parameters may be represented with the 4-digit code. The check digit encoded in area 138 and designated by the absence of a hole is used to check full key insertion, as will become apparent from the explanation below. Gripping portion 124 includes a small hole 143 by which the key is tethered to its corresponding flexible metal hose.

Areas 130–138 are symmetrical relative to the central key axis that is parallel to the direction of key insertion, the latter being indicated by the arrow in FIG. 2. Thus, the key shown in FIG. 2 may also be inserted into path entry 94 with its unseen surface facing the viewer. In other words, the key may be flipped 180 degrees about its longitudinal axis and so inserted into the path entry. The code signal that is generated will be the same in both instances. However, key insertion into path termination 96 is barred by the presence of pin 98. These features assure simplicity of construction and ease of use.

Figure 4:
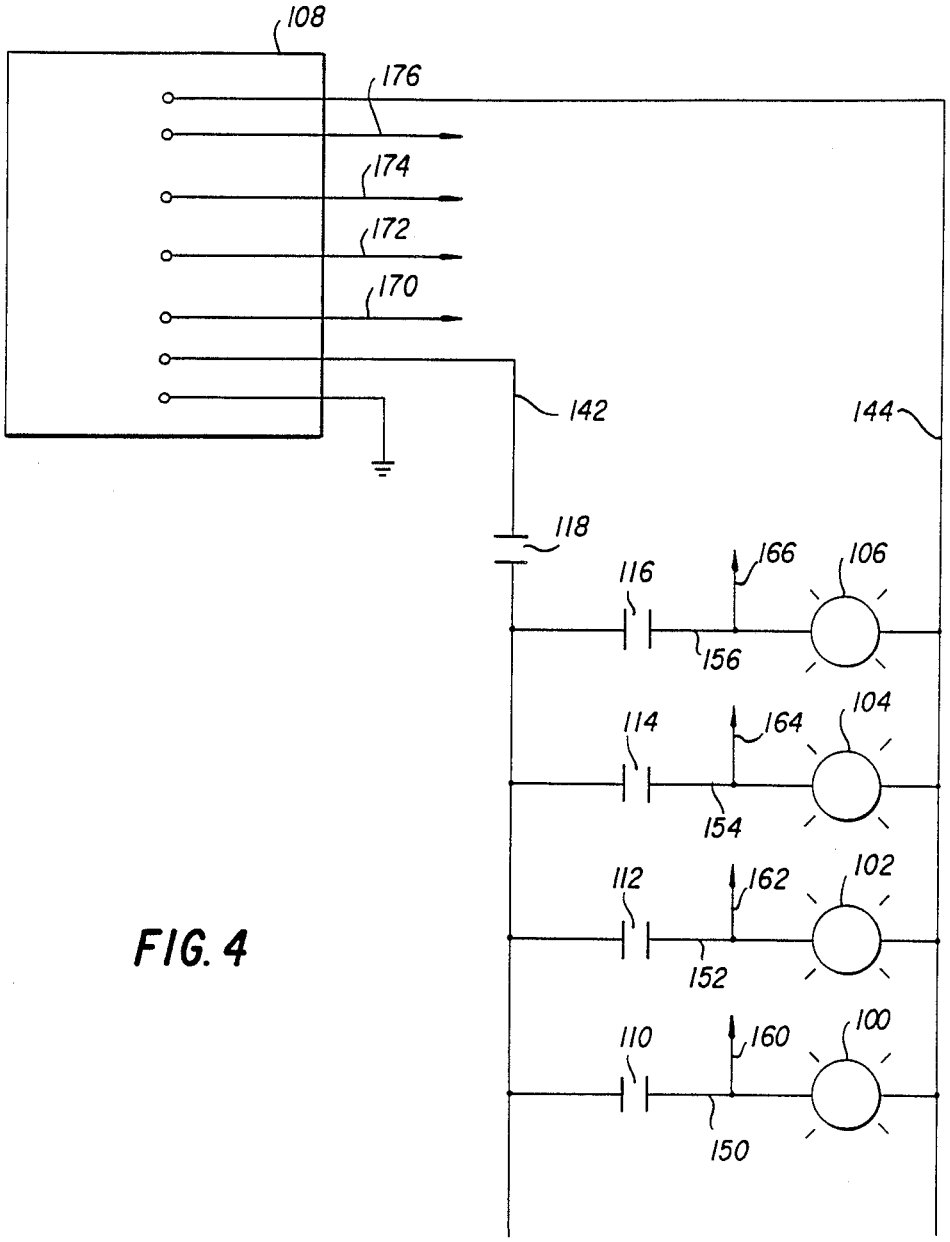
FIG. 4 is a circuit diagram of the control box.

FIG. 4 is a schematic circuit diagram of the interior of a representative control box 80. A power circuit includes a line 142 and a grounded line 144, both connected to connector plug 108 for receiving power from an external source. Check probe 118 is connected in series in line 142. Four signal circuits 150, 152, 154 and 156 are connected in parallel between lines 142 and 144, following check probe 118. As shown, probe 110 and signal light 100 are connected in series in signal circuit 150. Similarly, signal circuit 152 includes probe 112 and signal light 102 connected in series. Signal circuit 154 comprises probe 114 and signal light 104 connected in series; and signal circuit 156 includes probe 116 and signal light 106 connected in series.

As previously explained, each probe includes a switch and a probe coil which provides an RF field upon energization. The schematic representation of the signal probes in FIG. 4 is to be understood as indicating that each probe switch and probe coil are connected in series in their associated signal circuit. Similarly, the switch and coil belonging to check probe 118 are connected in series in the power circuit.

From the foregoing explanation, it will be clear that each of the proximity probes 110–118 is capable of connecting or disconnecting its associated circuit. Such connection or disconnection depends on the binary digit positioned opposite the probe and sensed by it when the selected key is fully inserted into the keyway. The connected/disconnected status of a signal circuit is indicated by the circuit signal provided on the output terminal of the circuit, i.e. on output terminals 160, 162, 164 and 166 of signal circuits 150, 152, 154 and 156 respectively. These circuit signals are applied in parallel to output lines 170, 172, 174 and 176 respectively, to provide a 4-digit, binary output signal representative of the code on the inserted key.

As mentioned earlier, the transfer area has a number of delivery points a–n, and a number of receiving points A–N which may be larger or smaller than the number of delivery points. For a particular chosen operation of the process or apparatus, one or more of these delivery points must be interconnected with a corresponding number of receiving points. For purposes of illustration, it is assumed that receiving points B and N are to be coupled to delivery points a and b for the chosen operation. This is implemented in the present invention by the selection of flexible hose 16 for interconnection with selected fixed station 40, and by the selection of flexible hose 22 for interconnection with selected fixed station 56. In a preferred embodiment of the invention, the aforesaid interconnections are made manually in the transfer area. In order to establish the proper operating parameters for the chosen operation, key 18, which is assigned to flexible hose 16 and is tethered thereto, is inserted into the keyway of control box 48, the latter being the control box assigned to fixed station 40 and being located nearby. Similarly, key 24 which is tethered to flexible hose 22, is inserted into the keyway of control box 54, the latter being assigned to fixed station 56 and located proximate thereto.

The steps that take place upon key insertion are best understood with reference to FIGS. 2 and 3. When key 82 is fully inserted into keyway 92, i.e. up to gripping portion 124, each of the discrete, indicia-bearing areas 130–138 of the key is positioned opposite one of probes 110–118. The probes do not touch the read portion 122 of the key. In that position of the key, the check digit indicia in area 138 confronts check probe 118. Since area 138 contains no hole, its presence in the RF field generated by the coil of probe 118 causes the power circuit to close and thereby to energize signal circuits 150–156. The application of power to each signal circuit energizes signal probes 110–116. As a result, each signal probe will inductively link the confronting digit on the inserted key.

If a hole is sensed, i.e. where there is a binary ZERO, the probe switch remains open and disconnects its associated signal circuit. If a binary ONE is sensed, i.e. where there is an absence of a hole, the probe switch closes and connects the associated signal circuit. As previously explained, the resulting circuit signals on output terminals 160–166 are applied in parallel to lines 170–176 respectively. The output signal so generated is representative of the code on the inserted key. The signal is applied to computer 70 by way of connector plug 108 and the electrical conduit connected thereto, the computer being at a location remote from control box 80.

Whenever a signal circuit is completed by the closing of a probe switch, the signal light connected in series in the same circuit is energized. The lights on cover 84 of control box 80 are grouped in the same manner as the probes within the control box. Thus, whenever an output signal is generated, the signal lights on the cover of the control box provide a visual indication of the code on the inserted key.

The present invention is not limited to an interlock system for a chemical process or apparatus, but is applicable to any process or apparatus wherein equipments selected from first and second pluralities of such equipment, e.g. from a first plurality of flexible hoses and from a second plurality of fixed interconnection stations respectively, must be interconnected for a chosen operation to be carried out and where it is desired to establish a particular set of operating parameters for such operation.

The invention, as described herein with respect to a preferred embodiment, offers a number of advantages over presently available interlock systems. For example, since the key consists of an integral metal plate, preferably about ⅛ inch thick, it is rugged and capable of withstanding the rough handling accorded such equipment in the environment of the transfer area, including impact by the relatively heavy ends of the flexible hoses which may be accidentally dropped on such a key. The absence of connector pins further enhances the ruggedness of the inventive arrangement by eliminating the possibility of having the pin bend or break upon connection or disconnection of the connector halves.

The absence of connector pins and of the corresponding pin holes renders the equipment relatively immune to the presence of dirt. Thus, even if dirt does intrude into the narrow space between a probe and the read portion of an inserted key, it will not materially interfere with the inductive linkage of the read portion and the sensing of the indicia thereon by a probe. Moreover, the present invention also provides a self-cleaning feature. Each insertion of a key into the keyway serves to clear dirt out of the latter. Specifically, path termination 96, although barred to key insertion, is open to the expulsion of dirt by a key inserted through the path entry. A further advantage of the present invention stems from the fact that sparking is avoided by the absence of any exposed electrical contacts. As pointed out above, this factor is of particular importance where the interlock system is used in an explosive environment.

The flexibility of the present arrangement, which allows key insertion with either key face pointing forward, has already been noted. It will be apparent that the invention is not limited to a 4-digit code, nor to the use of indicia that consist of the presence or absence of holes in a metal plate. Other indicia may be found useful, depending on the particular environment in which the interlock system is to be used. For example, in lieu of the arrangement shown, the key could be magnetized or demagnetized in the discrete areas 130–138 to represent the code and the check digit. Such indicia would, of course, require different types of sensing probes. The desired code may also be represented by means of indicia capable of being optically sensed, or of being read by tactile sensing, all without the use of exposed electrical contacts that present a danger in an explosive environment.

The information carrier may take a form different from the key of uniform thickness shown in the drawings. For example, it could be formed as an elongate plastic cylinder on which rings of metal are disposed wherever the code calls for a binary ONE. Alternatively, the cylinder could be formed as a composite of plastic and metal disks. Obviously such a key will require a keyway having a circular cross section to accommodate the cylinder. Other key shapes will readily suggest themselves.

In light of the foregoing discussion, it will be apparent to those skilled in the art that the present invention is not limited to the preferred embodiment illustrated and described. Numerous modifications, changes, substitutions and equivalents will now become apparent to those skilled in the art, all of which fall within the scope contemplated by the invention herein. Accordingly, it is intended that the present invention be limited solely by the scope of the appended claims.

What is claimed is:

1. An interlock system for establishing a different set of operating parameters for each of a number of different operations of an apparatus, each of said operations requiring the interconnection of different pieces of equipment selected from first and second pluralities of said equipment pieces, each of said parameter sets being designated by a different multi-digit binary code; said interlock system comprising:

a movable information carrier assigned to each of said first, plurality of equipment pieces, each of said carriers containing information representative of a different one of said codes;

a control unit assigned to each of said second plurality of equipment pieces;

each of said control units including signal circuit means and further including signal probe means responsive to the information on said carriers for connecting or disconnecting said signal circuit means;

means for positioning the assigned carrier and control unit of each pair of equipment pieces, selected for interconnection pursuant to a chosen operation so that the information on said assigned carrier is placed proximate the probe means of said assigned control unit clear of any intervening structure; and means for deriving a binary output signal from said signal circuit means representative of the code on said assigned carrier, said output signal being effective to establish a set of operating parameters applicable to said chosen operation.

2. An interlock system in accordance with claim 1 and further including means operatively associated with said signal circuit means for providing a visual indication of the code on said assigned carrier.

3. An interlock system in accordance with claim 1 wherein each of said movable carriers consists of a key, said information being located in successively spaced areas of said key in the form of discrete code indicia each representative of one digit of said multi-digit binary code;

said positioning means including a keyway on each of said control units capable of accepting said keys;

said signal circuit means comprising a group of separate signal circuits each corresponding to one of said code digits; and said probe means comprising separate signal probes successively positioned along said keyway, each of said probes being operatively associated with one of said signal circuits for connecting or disconnecting the latter in response to the indicia sensed by said probe;

whereby said binary output signal is derived in parallel from said group of signal circuits.

4. An interlock system in accordance with claim 3 wherein each of said keys further carries discrete indicia representative of a check digit spaced from said code indicia and substantially identical in form to the latter;

a power circuit for energizing said group of signal circuits; and a check probe positioned along said keyway spaced from said signal probes and substantially identical to the latter, said check probes being operatively associated with said power circuit to connect or disconnect the latter in response to a sensed check digit.

5. An interlock system in accordance with claim 4 wherein the keyway of each of said control units includes a path entry and a path termination;

each of said keys including an elongate read portion containing said indicia;

the position of said check digit on said read portion being chosen to fall opposite said check probe when said read portion is fully inserted into said keyway through said path entry;

whereby said power circuit is connected to energize said signal circuits only upon full insertion of a key.

6. An interlock system in accordance with claim 5 wherein each of said read portions terminates in a forward key end on which said check digit is located; and each check probe being positioned near the path termination of its associated keyway.

7. An interlock system in accordance with claim 6 wherein said path termination is barred to key insertion but is open to the expulsion of accumulated dirt by a key inserted through said path entry; and each of said keys further including a gripping portion of a width too large to enter said keyway.

8. An interlock system in accordance with claim 6 wherein the respective indicia on each key are symmetrical with respect to the central key axis parallel to the direction of key insertion;

whereby each key is reversibly insertable into said keyway through said path entry.

9. An interlock system in accordance with claim 6 wherein said read portion of each key comprises a metal plate of uniform thickness;

each of said indicia constituting either a hole in said plate or the absence of a hole representative of binary ZERO or ONE respectively; and said probes in each control unit being positioned so as to be proximate the read portion of a fully inserted key but out of contact therewith for inductively coupling the indicia on said read portion when said signal circuits are energized, each of said probes being responsive to the absence or presence of a hole to connect or disconnect respectively its corresponding signal circuit.

10. An interlock system in accordance with claim 9 and further including a signal light connected in series with the probe in each of said signal circuits, the signal lights of each of said control units being disposed to provide a visual indication of the code on the inserted key.

11. An interlock system in accordance with claim 10 wherein each piece of equipment of said second plurality is fixed in position;

each piece of equipment of said first plurality being movable for selective interconnection with said pieces of fixed equipment;

each of said keys being tethered to its assigned piece of movable equipment; and each of said control units being positioned near its assigned piece of fixed equipment.

12. An interlock system in accordance with claim 11 wherein each of said control units comprises a sealed enclosure containing said signal circuits and said probes, said enclosure having said keyway and said signal lights externally mounted thereon; and said probes extending through a wall of said enclosure into said externally mounted keyway.

13. An interlock system for establishing a different set of operating parameters for each of a number of different operations of an apparatus, each parameter set being designated by a unique multi-digit binary code, each of said operations requiring the interconnection of at least one fixed interconnection station selected from a first plurality of said stations disposed in a transfer area with at least one flexible chemical transport hose selected from a second plurality of said hoses present in said transfer area, each of said fixed stations being permanently coupled to a separate point for delivery of said chemicals out of said transfer area, each of said hoses being permanently coupled at one end thereof to a separate point for receiving said chemicals into said transfer area and being selectively connectable at its other end to one of said fixed stations; said interlock system comprising:

a plurality of keys each tethered to one of said flexible hoses, each of said keys including a read portion comprising an elongate metal plate having uniform width and thickness, said key further including a gripping portion of a width greater than the width of said read portion;

each of said read portions bearing the digits of one of said codes and a check digit, said digits being successively spaced along the long dimension of said read portion, each of said digits taking the form of a hole in said metal plate or the absence of a hole representative of binary ZERO or ONE respectively;

a control box positioned proximate each of said fixed stations, each of said control boxes being sealed to keep out said chemicals;

a keyway externally mounted on one wall of each control box and including a path entry and a path termination, said keyway being configured to permit key insertion through said path entry up to said key gripping portion, said path termination being constructed to bar key insertion but permitting the expulsion of accumulated dirt by a key inserted through said path entry;

a group of signal circuits in said control box connected in parallel with each other, each of said signal circuits corresponding to a different digit of said multi-digit code;

a signal probe connected in series in each of said signal circuits;

said control box further containing a power circuit connected in series with said group of parallel-connected signal circuits for energizing said signal circuits;

a check probe connected in series in said power circuit;

each of said probes extending through a wall of said control box into said external keyway so as to be in proximity but out of contact with an inserted key, said probes being successively spaced along said keyway for inductive linkage by each probe with the proximate digit of an inserted key, each of said probes being responsive to connect or disconnect its associated circuit in accordance with said inductively linked digit; and means for deriving a multi-digit output signal in parallel from said group of signal circuits representative of the code on said inserted key;

whereby, for each interconnection of a selected hose with a selected fixed station, the applicable set of parameters for the chosen operation is established upon insertion of the key tethered to said selected hose into the keyway of the control box positioned proximate said selected fixed station.

14. An interlock system in accordance with claim 13 and further including a separate signal light connected in series with each of said signal circuits, said signal lights being externally mounted on said control box and being grouped to provide a visual indication of the code on said inserted key.

15. An interlock system in accordance with claim 14 wherein the read portion of each key terminates in a forward key end;

each of said check digits being located near the forward end of its key; and said probes being positioned along their associated keyway such that said check probe is located closest to said path termination;

whereby said check digit appears opposite said check probe when a key is fully inserted in said keyway to allow energization of said signal circuits only in the fully inserted position of said key.

16. An interlock system in accordance with claim 15 wherein each of said keys consists of an integral metal plate of uniform thickness containing both said read and gripping portions; and said gripping portion including a hole for tethering said key.

* * * * *